US009447936B1

(12) United States Patent
Ho

(10) Patent No.: US 9,447,936 B1
(45) Date of Patent: Sep. 20, 2016

(54) LIQUID MOTION LAMP WITH ISOLATED HEATING DEVICE

(71) Applicant: Su-Fang Ho, New Taipei (TW)

(72) Inventor: Su-Fang Ho, New Taipei (TW)

( * ) Notice: Subject to any disclaimer, the term of this patent is extended or adjusted under 35 U.S.C. 154(b) by 0 days.

(21) Appl. No.: 14/717,027

(22) Filed: May 20, 2015

(51) Int. Cl.

| | |
|---|---|
| ***F21S 10/00*** | (2006.01) |
| ***F21V 29/90*** | (2015.01) |
| ***F21V 23/02*** | (2006.01) |
| ***F21V 19/00*** | (2006.01) |
| ***F21V 17/10*** | (2006.01) |
| ***F21V 29/70*** | (2015.01) |
| ***F21V 23/00*** | (2015.01) |
| *F21Y 101/02* | (2006.01) |

(52) U.S. Cl.
CPC ..... *F21S 10/002* (2013.01); *F21V 17/101* (2013.01); *F21V 19/007* (2013.01); *F21V 19/0035* (2013.01); *F21V 23/002* (2013.01); *F21V 23/02* (2013.01); *F21V 29/70* (2015.01); *F21V 29/90* (2015.01); *F21Y 2101/02* (2013.01)

(58) Field of Classification Search
CPC ..... F21S 10/002; F21V 1/00; F21V 3/0454; F21V 9/12; F21V 29/10; F21V 29/83; F21V 29/90; F21V 31/04; F21W 2121/006; F21Y 2103/003; F21Y 2113/005; G09F 13/24; Y10S 362/806
See application file for complete search history.

(56) References Cited

U.S. PATENT DOCUMENTS

| | | | | | |
|---|---|---|---|---|---|
| 3,568,927 | A * | 3/1971 | Scurlock | G09F 13/24 | 239/17 |
| 4,072,855 | A * | 2/1978 | Marchese | F21S 6/004 | 362/101 |
| 4,742,439 | A * | 5/1988 | Choate | F21S 10/002 | 353/1 |
| 5,803,580 | A * | 9/1998 | Tseng | F21S 10/002 | 362/123 |
| 5,938,318 | A * | 8/1999 | Mattsen | F21S 10/002 | 362/101 |
| 6,604,835 | B2 * | 8/2003 | Zale | F21S 10/002 | 362/101 |
| 7,647,716 | B2 * | 1/2010 | Finkle | A47F 11/10 | 40/406 |
| 7,905,728 | B2 * | 3/2011 | Piontek | G09B 23/12 | 366/273 |
| 8,294,389 | B2 * | 10/2012 | Finkle | F21S 6/005 | 315/117 |
| 8,695,247 | B1 * | 4/2014 | Yang | G09F 13/24 | 362/101 |
| 2003/0202340 | A1 * | 10/2003 | Wu | F21S 6/002 | 362/101 |
| 2005/0183299 | A1 * | 8/2005 | Lee | G09F 19/02 | 40/406 |
| 2006/0215397 | A1 * | 9/2006 | Lee | F21S 10/002 | 362/161 |
| 2014/0003036 | A1 * | 1/2014 | Ho | F21S 10/002 | 362/101 |

* cited by examiner

*Primary Examiner* — Hargobind S Sawhney
(74) *Attorney, Agent, or Firm* — Rosenberg, Klein & Lee

(57) ABSTRACT

A liquid motion lamp with isolated heating device has an isolated heating device disposed inside a mounting seat, including a cement resistor connecting to AC power supply and a constant current driver. The cement resistor would produce heat after being electrified and cause the flowing of the liquids in the liquid motion lamp. The constant current driver would convert the AC power into DC power for the LED bulb to project lights on the liquid motion lamp. With the isolated circuits of lights and heat as a combined composite module, the liquid motion lamp has great efficiency by distributing the sources of lights and heat, saving the energy and prolonging the durability of the LED bulb.

10 Claims, 7 Drawing Sheets

LIQUID MOTION LAMP WITH ISOLATED HEATING DEVICE

BACKGROUND OF THE INVENTION

1. Field of the Invention

The present invention relates to a liquid motion lamp, particularly to one that has a LED bulb projecting lights and an isolated cement resistor to produce heat, forming the structure of a liquid motion lamp with isolated heating device.

2. Description of the Related Art

Liquid motion lamps can cause the flowing of a first liquid substance inside by the heat produced by bulbs thereof; a second substance in the first liquid substance is therefore flowing as well. Besides, the random flowing and the lights projected from the bulbs create a splendid and magnificent visual effect. A liquid motion lamp has at least one bulb to provide the heat energy for the liquid and substances inside to flow around. However, the temperature of the bulb would rise increasingly with long-term usage. This may cause serious damages and harm to the users, and there is a problem of expenditure of bulbs as well. Such structure has been disclosed in U.S. Pat. No. 3,570,156.

Liquid motion lamps have been a favorite choice for decorative fittings. Recently, operators started to put light bulbs on the lamps to expand a lighting function, and such application has grown favorable among the consumers. Nevertheless, the heat energy produced by the LED bulb is not enough to cause the flowing of the liquids in the liquid motion lamp. On the other hand, nowadays there are glitters put inside the liquid motion lamp together with the liquids to increase the visual effects. However, the glitters are prone to fade due to long-term soaking in high temperature and collision in the liquids; the ultraviolet lights emitted from a conventional light bulb would also cause the fading of the glitters and the visual effects lacks of richness either.

Therefore, the inventor has strived to achieve vivid visual effects with longer durability of the LED bulb in a liquid motion lamp. Moreover, a liquid motion lamp combined with lighting function would be a major breakthrough in the industry as well

SUMMARY OF THE INVENTION

A primary object of the present invention is to provide a liquid motion lamp with isolated heating device that has an isolated structure of a cement resistor from a light-projecting LED bulb thereof, in order to achieve great efficiency by separating the sources of lights and heat, featuring the present invention as energy-saving and prolonging the durability of the LED bulb thereof.

Another object of the present invention is to provide a liquid motion lamp with isolated heating device that has isolated circuits arranged in a pre-determined distance to provide lights and heat energy separately in a single unit, prolonging the durability of the LED bulb thereof.

To achieve the objects mentioned above, the present invention comprises a base frame having an AC supply cord arranged through; a mounting seat with a hollow section arranged therein disposed on the base frame; a transparent bottle disposed on the mounting seat as a liquid motion lamp with liquids and a plurality of glitters therein; an isolated heating device disposed in the mounting seat, comprising a constant current driver, at least one substrate, a cement resistor, and a LED bulb; the constant current driver including a rectifying circuit and a driving circuit with the front end thereof connected to a power supply cord for converting AC power into DC power; the cement resistor being disposed on the substrate and connected to the AC power to produce heat for the liquid motion lamp; the LED bulb being disposed on the substrate and connected to the constant current driver to obtain DC power and become the light source for the liquid motion lamp; the cement resistor being arranged in a pre-determined distance from the LED bulb so as to form an isolated heating device with an isolated circuit to be combined with a lighting circuit as a composite module; whereby the cement resistor would produce heat when the AC supply cord is electrified, causing the flowing of the liquids in the liquid motion lamp, and the LED bulb would project lights when receiving the DC power and create a vivid visual effect when the lights are reflected by the plurality of glitters in the liquid motion lamp.

The substrate may further include a first substrate and a second substrate as the first substrate with a space in the middle being electrically connected to the AC power and having the cement resistor connected from above with a pair of connecting pins, and the second substrate having the LED bulb connected thereon and exposed in the space of the first substrate by combining from below, forming isolated circuits of lights and heat as a combined composite module with the cement resistor being arranged above the LED bulb in a pre-determined distance.

In addition, the present invention may further include a heat dissipating rack disposed in the mounting seat, and the composite module with isolated circuits is disposed on the heat dissipating rack; and the bottom of the composite module can be fixed on the heat dissipating rack with conducting adhesive.

Furthermore, the heat dissipating rack is a hollow case for the constant current driver to be disposed therein, and further has a fixing tube connecting the bottom thereof with the lower end of the fixing tube fixedly penetrating through the base frame; the AC supply cord is connected to the constant current driver and the first substrate by passing through the fixing tube from the base frame to the heat dissipating rack.

With structures disclosed above, the present invention has isolated circuits providing lights and heat energy—the cement resistor producing heat and the LED bulb providing lights; and the circuits are arranged separately in a pre-determined distance in one single unit, achieving features of space-saving and energy-saving with longer durability of the LED bulb and greater efficiency overall.

DETAILED DESCRIPTION OF THE PREFERRED EMBODIMENT

Figure 1:
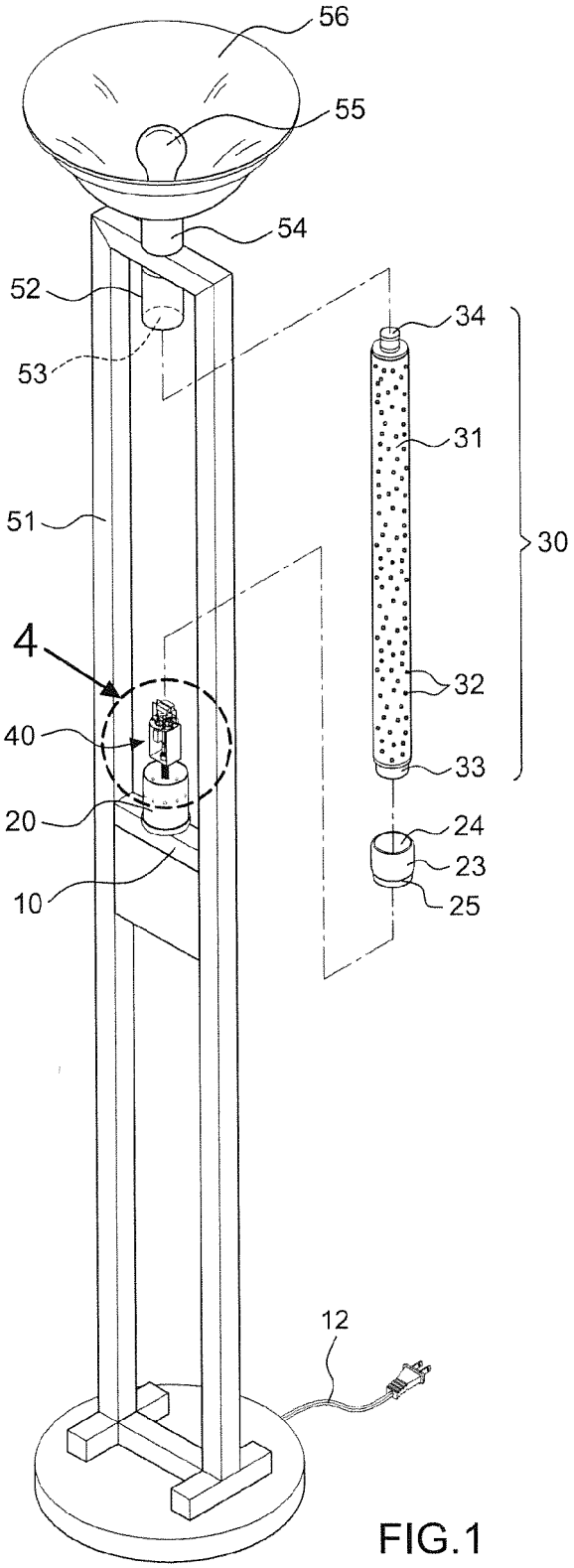
FIG. 1 is an exploded view of the present invention in an applicable embodiment.

Referring to FIGS. 1-6, the structure of the present invention mainly comprises a base frame 10, a mounting seat 20, a liquid motion lamp 30 and an isolated heating device 40.

The base frame 10 has an AC supply cord 12 arranged through. The mounting seat 20 is disposed on the base frame 10 with a hollow section 21 arranged therein and at least one heat dissipating hole 211 arranged on the periphery thereof. The liquid motion lamp 30 is a transparent bottle disposed on the mounting seat 20 with liquids 31 and a plurality of glitters 32 therein. The isolated heating device 40 is disposed in the hollow section 21 of the mounting seat 20 and comprises a constant current driver 41, at least one substrate 42, a cement resistor 43, a LED bulb 44 and a heat dissipating rack 45. The constant current driver 41 is connected to an AC power supply cord 12 for converting AC power into DC power supply 13.

In this embodiment, the substrate 42 may include a first substrate 42*a* and a second substrate 42*b*. The first substrate 42*a* is electrically connected to an AC power supply 14 and has a space 421 in the middle; the cement resistor 43 is connected to the first substrate 42*a* with a pair of connecting pins 431 from above. The LED bulb 44 is disposed on the second substrate 42*b* which combines with the first substrate 42*a* from below, exposing itself in the space of the first substrate 42*a*, thus forming a combined composite module 42A with isolated circuits of lights and heat as the cement resistor 43, the source of heat energy, being arranged above the LED bulb 44, the source of lights, in a pre-determined distance.

In this embodiment, the heat dissipating rack 45 is disposed in the mounting seat 20 with the composite module 42A with isolated circuits disposed thereon; and the bottom of the composite module 42A can be fixed on the heat dissipating rack 45 with conducting adhesive 422.

Furthermore, the heat dissipating rack 45 is a hollow case for the constant current driver 41 to be disposed therein, and the bottom thereof has a nut 46 connecting a fixing tube 22 with the lower end of the fixing tube 22 penetrating through the base frame 10 and being fixed on the base frame 10 by a nut 47. The AC supply cord 12 is separately connected to the constant current driver 41 and the first substrate 42*a* by passing through the fixing tube 22 from the base frame 10 to the heat dissipating rack 45; and the first and second substrate 42*a*, 42*b* are fixed on the heat dissipating rack 45 by a screw 423.

In an applicable embodiment, the present invention may include an assembling element 23 which has a hollow space 24 therein and an engaging section 25 at the lower end thereof, to fixedly engage in the hollow section 21 of the mounting seat 20 so that the assembling element 23 would be fixedly engaging the mounting seat 20; and the liquid motion lamp 30 has an inserting section 33 to be inserted into the hollow space 24 in the assembling element 23 to fix the liquid motion lamp 30 on the assembling element 23.

Figure 2:
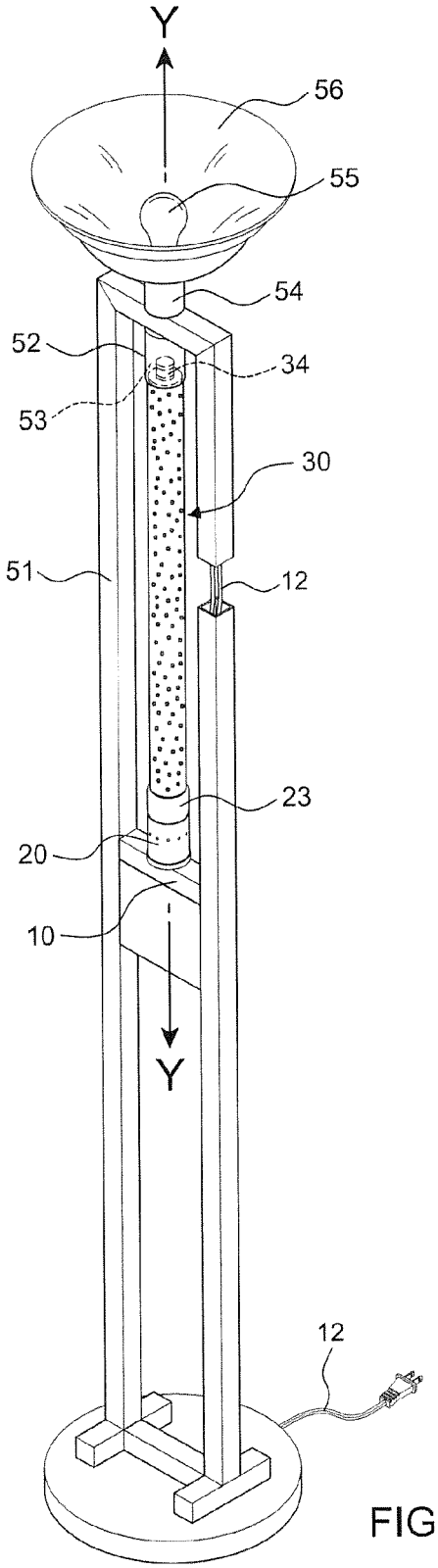
FIG. 2 is a perspective view of the present invention in an applicable embodiment.
Figure 2A:
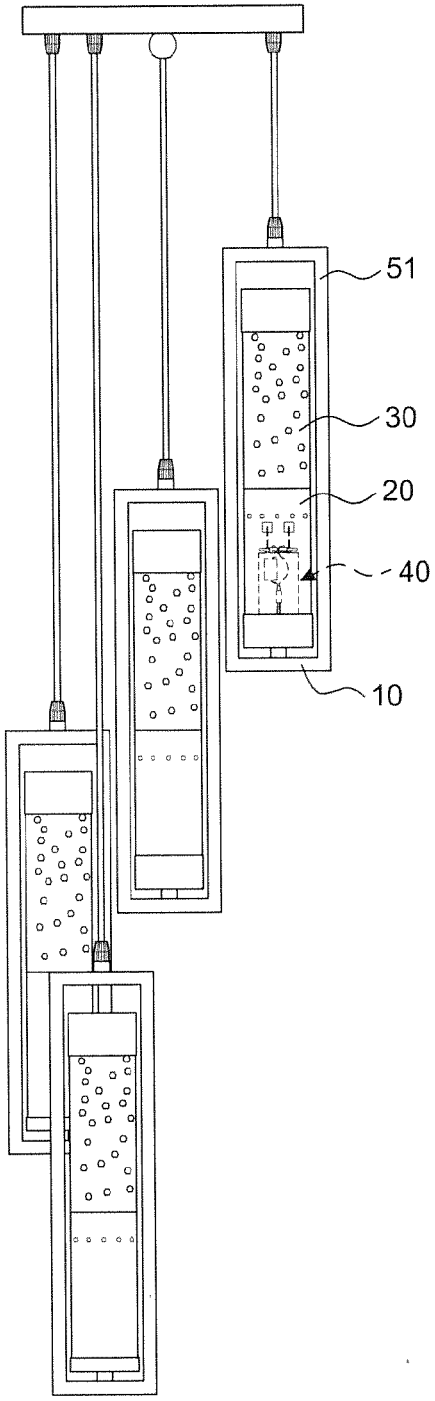
FIG. 2A is a practical application view of the present invention in another applicable embodiment.

In an applicable embodiment illustrated in FIGS. 1 and 2, the present invention may further include a hollow supporting bracket 51 connecting the base frame 10 with the mounting seat 20 as the upper end thereof having an upper fixing seat 52 that has an engaging space 53 therein and is arranged in the same axis Y-Y of the mounting seat 20, perpendicularly to the base frame 10, for the inserting section 33 of the liquid motion lamp 30 to be inserted into the assembling element 23 and the top end 34 of the liquid motion lamp 30 to be perpendicularly fixed in the engaging space 53 of the upper fixing seat 52. The liquid motion lamp 30 is therefore located vertically along the axis Y-Y. Since the upper fixing seat 52 has the engaging space 53 and the assembling element 23 has the engaging section 25, the liquid motion lamp 30 is able to displace together with the assembling element 23, making it easily engaged and disengaged. The present invention further includes a bulb holder 54 disposed on the upper fixing seat 52 connecting to the AC supply cord 12 through the hollow supporting bracket 51. FIG. 2 illustrates the present invention in an applicable embodiment, including a bulb 55 disposed in the bulb holder 54 and a lampshade 56 disposed above the bulb holder 54, so as to form a device combining the liquid motion lamp and a lighting bulb. Also, the present invention can be applied to pedant lamps as shown in FIG. 2A.

Figure 3:
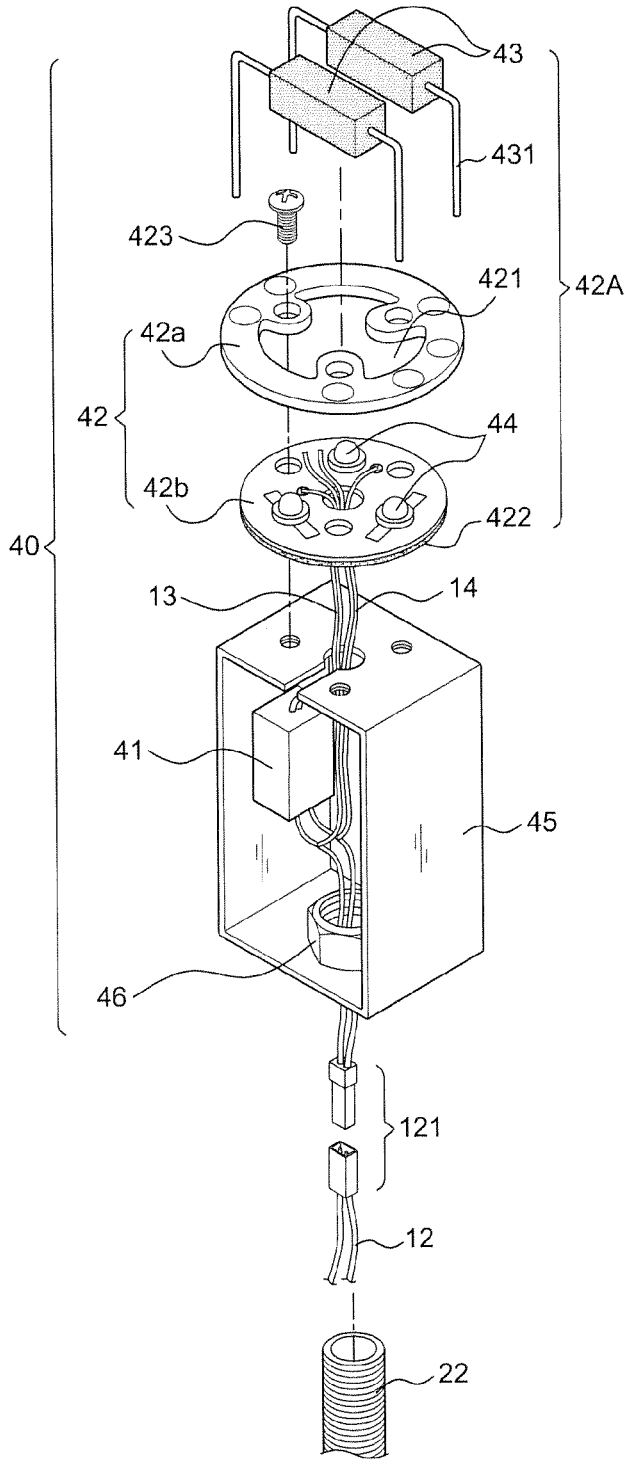
FIG. 3 is an exploded view of the isolated heating device of the present invention.
Figure 4:
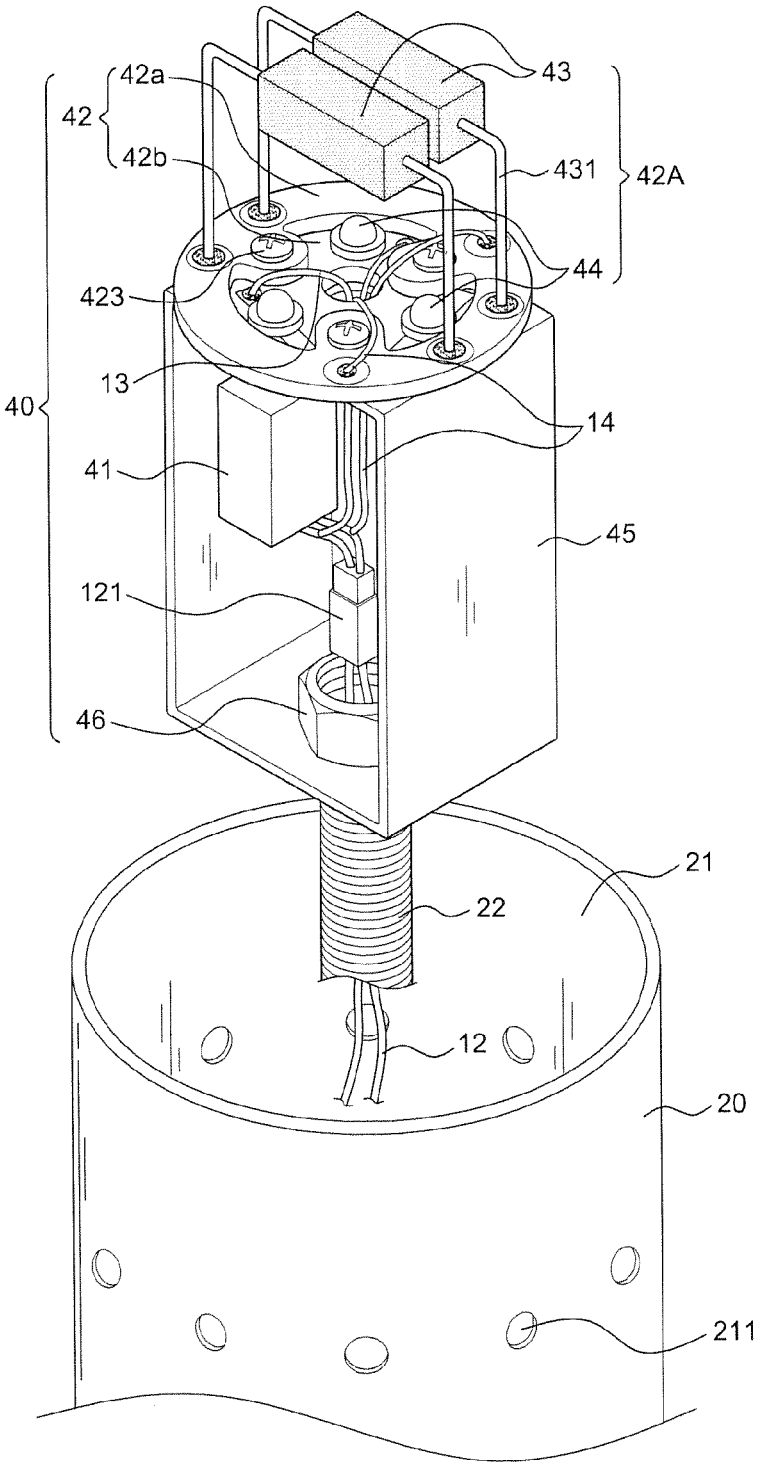
FIG. 4 is a perspective view of the isolated heating device thereof.
Figure 5:
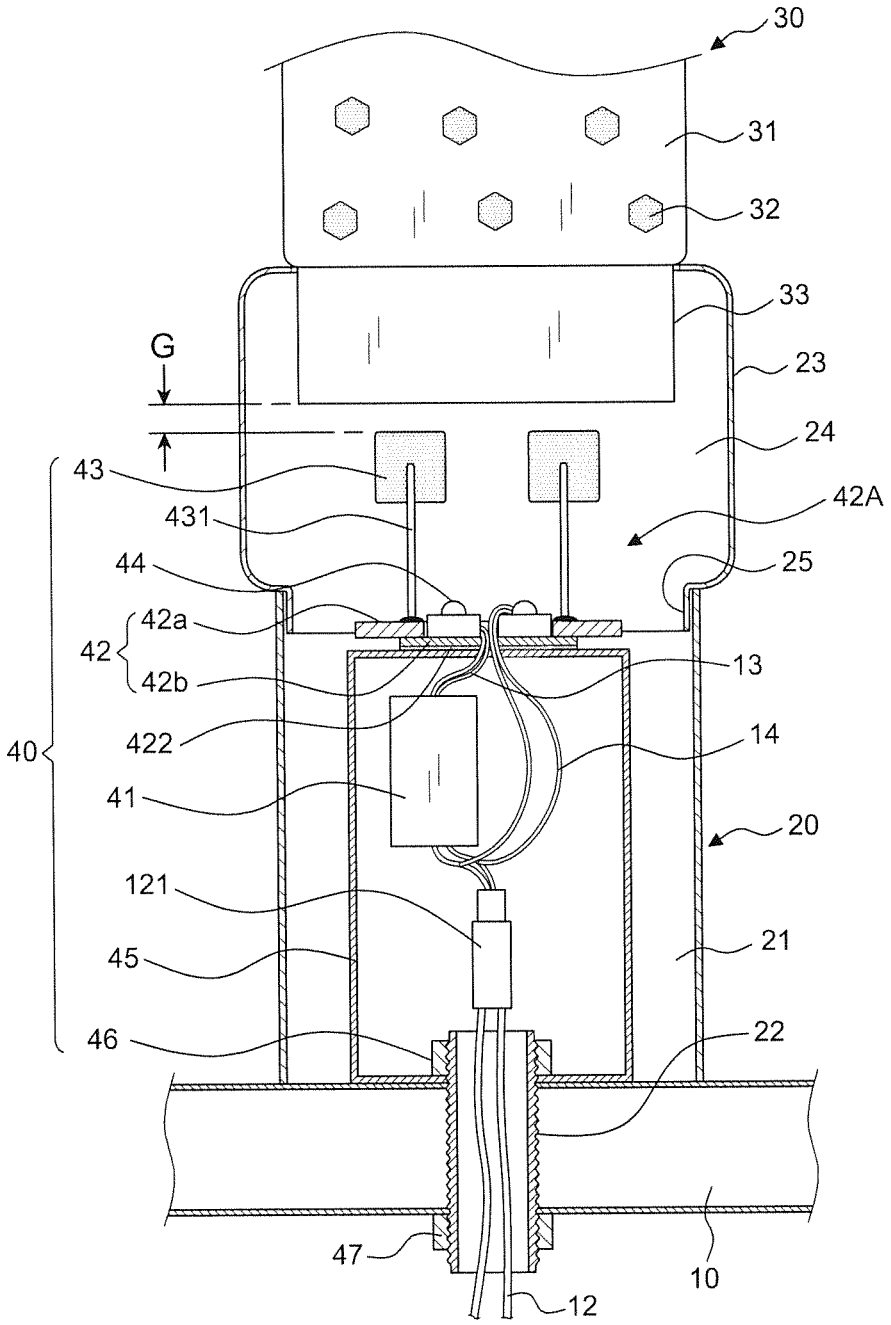
FIG. 5 is a partially enlarged sectional view of the present invention in a preferred embodiment.

Further referring to FIGS. 3-5, the constant current driver 41 of the present invention has the front end thereof connected to the AC supply cord 12 with a connector 121, and the rear end thereof would output constant DC power supply 13 after conversion of the constant current driver 41. In this embodiment, there are two cement resistors 43. The connecting pins 431 are arranged in certain length, about 10 to 25 mm; when they are welded on the first substrate 42*a* and electrified by connection with the AC power supply 14, the cement resistors 43 would produce heat at high degree of temperature and become the heat source for the liquid motion lamp 30 due to the arrangement of the cement resistors 43 being disposed under the transparent bottle of the liquid motion lamp 30 in a short distance G for a few millimeters. With the distance from the first substrate 42*a* to the cement resistors 43, the first substrate 42*a* would not be affected by the heat. The LED bulb 44 is disposed on the second substrate 42*b*, fixed on the heat dissipating rack 45 by conducting adhesive 422 and connected to the constant current driver 41 providing constant DC power supply 13. When being electrified, the LED bulb 44 would project lights to the liquid motion lamp 30 and the heat produced by the LED bulb 44 would be dissipated by the heat dissipating rack 45. Thus, the structure of separated sources of lights and heat is completed.

Whereby the cement resistor 43 would produce heat when the AC supply cord 12 is electrified, causing the flowing of the liquids 31 in the liquid motion lamp 30, and the LED bulb 44 would project lights when receiving the DC power from the constant current driver 41 and create a vivid visual effect when the lights are reflected by the plurality of glitters 32 in the liquid motion lamp.

Figure 6:
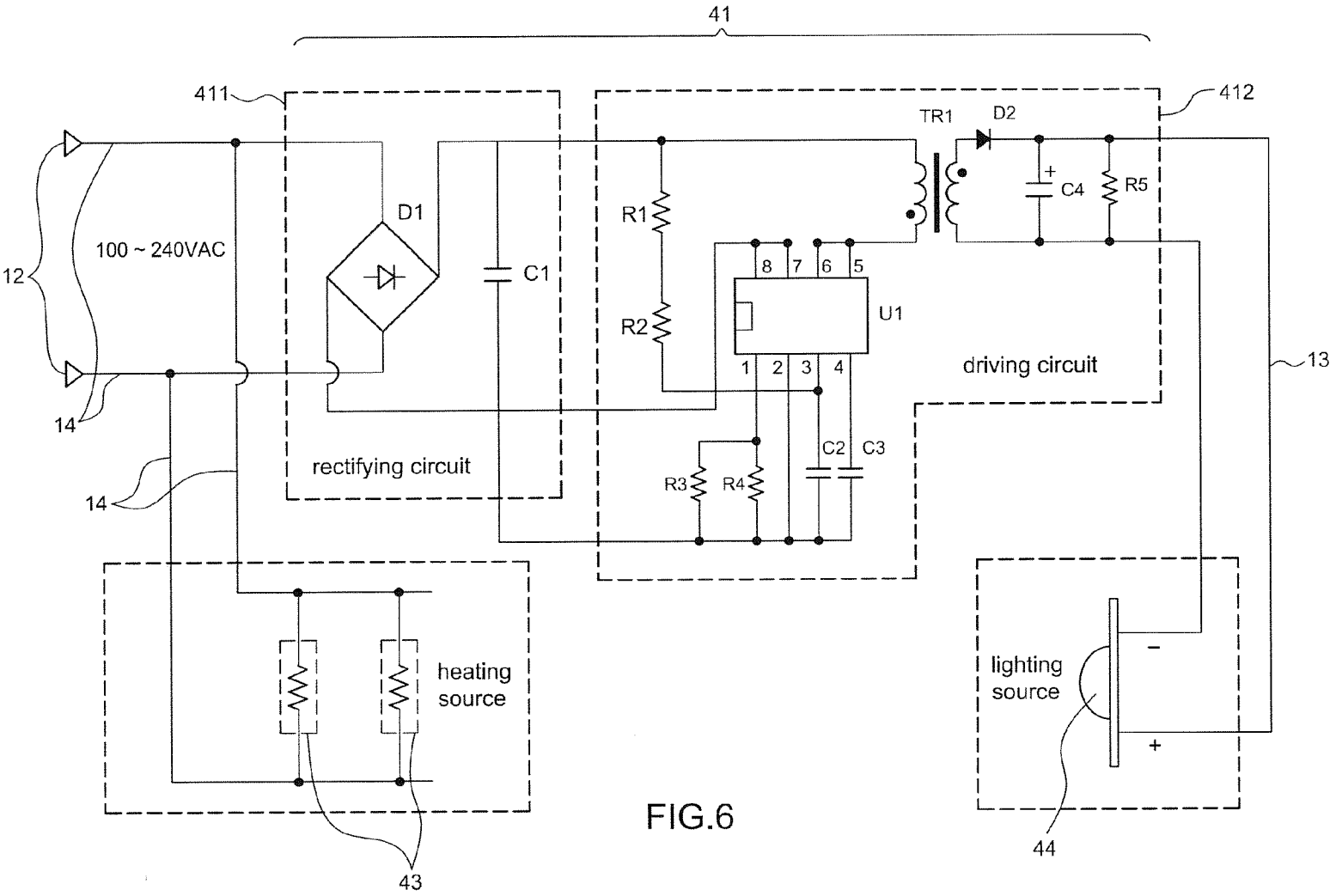
FIG. 6 is a circuit diagram of the constant current driver thereof.

FIG. 6 is a circuit diagram of the constant current driver 41. The constant current driver 41 comprises a rectifying circuit 411 and a driving circuit 412. The rectifying circuit 411 has the AC supply cord 12 with 100-240V at the input terminal, rectifies the AC power and produces DC power, then convert the DC power into constant DC current by the driving circuit 421. The forward bias and the current of the DC power are in relation of index numbers; therefore, a small change in the voltages would hugely affect the currents and thus the lighting of the LED bulb 44 that obtains power from the DC power. The LED bulb 44 may be permanently damaged with serious effects. The function of the driving circuit 412 is to convert the power supply into a specific voltages and ampere of currents for the LED bulb 44; consequently the output terminal of the driving circuit 412 is a constant current supply that can adjust the voltages with the LED bulb 44. The DC power supply 13 in the figure is the constant current supply for the LED bulb 44 to emit lights and project the lights to the liquid motion lamp 30.

Also, in this preferred embodiment, the present invention has the cement resistors 43 to produce heat. A cement resistor is formed by having a wire-wound resistor put inside a square case and filled with special cement with non-flammability and heat resistance. Such resistor has larger resistance that requires higher currents to pass through; therefore, as shown in the figure, the AC power supply 14 is directly connected to the AC supply cord 12. The rectifying circuit 411 includes a bridge rectifier D1 and related electrical components, and the driving circuit 412 includes a LED constant current IC U1 connected to related components. The LED constant current IC U1 has protection circuits for overload and over heat with a small volume, and therefore is suitable for the present invention. Such device is commonly seen in the markets and therefore is not the primary patented object.

The present invention applied the structure of separated circuits to the liquid motion lamp 30, avoiding the LED bulb 44 from the effects of the heat energy produced by the cement resistors 43 and ensuring longer durability of the LED bulb 44. Additionally, the present invention further has the engaging section 25 of the assembling element 23 and the engaging space 53 of the upper fixing seat 52 to make the transparent bottle of the liquid motion lamp 30 to be easily engaged and disengaged. Also, the liquid motion lamp 30 has the function of lighting as well with the combination with the bulb 55. Furthermore, the LED bulb 44 only needs a few watts to emit lights, and it does not emit ultraviolet lights, prolonging the fading of the glitters 32 in the transparent bottle; the LED bulb 44 can also change the color of the lights, providing a magnificent visual effects with the reflection in different colors.

With the structures disclosed above, the present invention has isolated circuits providing lights and heat energy the cement resistor 43 producing heat and the LED bulb 44 providing lights; and the circuits are arranged separately in a pre-determined distance in one single unit, achieving features of space-saving and energy-saving with longer durability of the LED bulb 44 and greater efficiency overall.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A liquid motion lamp with isolated heating device, comprising:

a base frame having an AC supply cord arranged through;

a mounting seat with a hollow section arranged therein disposed on the base frame;

a transparent bottle disposed on the mounting seat as a liquid motion lamp with liquids and a plurality of glitters therein;

an isolated heating device disposed in the mounting seat, comprising a constant current driver, at least one substrate, a cement resistor, and a LED bulb; the constant current driver including a rectifying circuit and a driving circuit with the front end thereof connected to a power supply cord for converting AC power into DC power; the cement resistor being disposed on the substrate and connected to the AC power to produce heat for the liquid motion lamp; the LED bulb being disposed on the substrate and connected to the constant current driver to obtain DC power and become the light source for the liquid motion lamp; the cement resistor being arranged in a pre-determined distance from the LED bulb so as to form an isolated heating device with an isolated circuit to be combined with a lighting circuit as a composite module;

whereby the cement resistor would produce heat when the AC supply cord is electrified, causing the flowing of the liquids in the liquid motion lamp, and the LED bulb would project lights when receiving the DC power and create a vivid visual effect when the lights are reflected by the plurality of glitters in the liquid motion lamp.

2. The liquid motion lamp with isolated heating device as claimed in claim 1, wherein the substrate includes a first substrate and a second substrate as the first substrate with a space in the middle being electrically connected to the AC power and having the cement resistor connected from above with a pair of connecting pins, and the second substrate having the LED bulb connected thereon and exposed in the space of the first substrate by combining from below, forming isolated circuits of lights and heat as a combined composite module with the cement resistor being arranged above the LED bulb in a pre-determined distance.

3. The liquid motion lamp with isolated heating device as claimed in claim 2, wherein the present invention further includes a heat dissipating rack disposed in the mounting seat, and the composite module with isolated circuits is disposed on the heat dissipating rack.

4. The liquid motion lamp with isolated heating device as claimed in claim 3, wherein the bottom of the composite module with isolated circuits has conducting adhesive to be fixed on the heat dissipating rack.

5. The liquid motion lamp with isolated heating device as claimed in claim 4, wherein the heat dissipating rack is a hollow case for the constant current driver to be disposed therein.

6. The liquid motion lamp with isolated heating device as claimed in claim 5, wherein the heat dissipating rack further has a fixing tube connecting the bottom thereof with the lower end of the fixing tube fixedly penetrating through the base frame.

7. The liquid motion lamp with isolated heating device as claimed in claim 6, wherein the AC supply cord is connected to the constant current driver and the first substrate by passing through the fixing tube from the base frame to the heat dissipating rack.

8. The liquid motion lamp with isolated heating device as claimed in claim 1, wherein the present invention further includes an assembling element engaging between the liquid motion lamp and the mounting seat which has a hollow space therein and an engaging section at the lower end thereof to fixedly engage on the mounting seat so that the assembling element would be fixedly engaging the mounting seat; and the liquid motion lamp has an inserting section to be inserted into the hollow space in the assembling element to fix the liquid motion lamp on the assembling element.

9. The liquid motion lamp with isolated heating device as claimed in claim 1, wherein the present invention further includes a hollow supporting bracket connecting the base frame with the mounting seat as the upper end thereof having an upper fixing seat that has an engaging space therein and is arranged in the same axis of the mounting seat, perpendicularly to the base frame, for the top end of the liquid motion lamp to be perpendicularly fixed in the engaging space of the fixing seat.

10. The liquid motion lamp with isolated heating device as claimed in claim 9, wherein the present invention further includes a bulb holder disposed on the upper fixing seat connecting to the AC supply cord through the hollow supporting bracket.

* * * * *